US008157230B2

(12) United States Patent
Krueger et al.

(10) Patent No.: US 8,157,230 B2
(45) Date of Patent: Apr. 17, 2012

(54) SHELF SUPPORT

(75) Inventors: Daniel L. Krueger, Rockford, MI (US); Matthew J. Alferink, Middleville, MI (US)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 329 days.

(21) Appl. No.: 12/341,165

(22) Filed: Dec. 22, 2008

(65) Prior Publication Data

US 2010/0155354 A1 Jun. 24, 2010

(51) Int. Cl.
*A47G 29/02* (2006.01)

(52) U.S. Cl. ... 248/243; 248/235; 248/250; 248/220.43; 248/223.31; 248/222.51

(58) Field of Classification Search ..... 248/243, 248/235, 250, 242, 241, 220.43, 223.31, 248/220.41, 222.51; 211/87.01, 94.01, 283
See application file for complete search history.

(56) References Cited

U.S. PATENT DOCUMENTS

| | | | | | |
|---|---|---|---|---|---|
| 908,772 | A | | 1/1909 | Hoffmann | |
| 1,235,679 | A | | 8/1917 | Gerberich | |
| 1,504,522 | A | | 8/1924 | Sherer | |
| 1,504,523 | A | | 8/1924 | Sherer | |
| 1,537,267 | A | * | 5/1925 | Schaefer | 248/243 |
| 1,577,066 | A | | 3/1926 | Medart et al. | |
| 1,753,012 | A | | 4/1930 | Levene | |
| 1,829,009 | A | * | 10/1931 | Madsen | 248/243 |
| 1,852,598 | A | * | 4/1932 | Vogt | 248/243 |
| 1,853,018 | A | * | 4/1932 | Knape | 248/243 |
| 1,872,429 | A | * | 8/1932 | Eaglesfield | 248/243 |
| 1,952,111 | A | | 3/1934 | Bales | |
| 1,983,470 | A | | 12/1934 | Knape | |
| 2,261,956 | A | | 11/1941 | Brownlie et al. | |
| 2,471,839 | A | * | 5/1949 | Schumacher | 248/222.13 |
| 2,542,753 | A | | 2/1951 | De Swart | |
| 2,732,955 | A | * | 1/1956 | Holmquist | 108/108 |
| 2,790,616 | A | | 4/1957 | Cardinal, Jr. | |
| 2,839,350 | A | | 6/1958 | Hill at al. | |
| 2,913,038 | A | * | 11/1959 | McDerby | 248/628 |
| 3,081,717 | A | | 3/1963 | Yurevich | |
| 3,186,364 | A | * | 6/1965 | Angelus et al. | 108/146 |
| 3,269,338 | A | | 8/1966 | Shewell | |
| 3,299,839 | A | | 1/1967 | Nordbak | |
| 3,306,466 | A | | 2/1967 | Liston | |
| 3,522,920 | A | | 8/1970 | Gray et al. | |
| 3,536,015 | A | | 10/1970 | Textoris | |
| 3,895,774 | A | | 7/1975 | Sharp | |
| 3,936,024 | A | | 2/1976 | Jung | |
| 3,954,243 | A | | 5/1976 | Sharp et al. | |
| 3,984,077 | A | | 10/1976 | Shine | |
| 3,994,462 | A | | 11/1976 | Shine | |
| 4,013,022 | A | | 3/1977 | Walter et al. | |
| 4,064,995 | A | | 12/1977 | Bustos | |
| 4,101,108 | A | | 7/1978 | Klein | |
| 4,193,649 | A | * | 3/1980 | Sharon | 384/19 |

(Continued)

OTHER PUBLICATIONS

Knape & Vogt website pages illustrating shelving pilaster and pilaster supports (7 pages total).

*Primary Examiner* — Nkeisha Smith
(74) *Attorney, Agent, or Firm* — Cook Alex Ltd.

(57) ABSTRACT

Shelf supports and methods of use of the same are disclosed. The shelf supports include a stop member that limits the deflection of the body of the shelf support.

15 Claims, 4 Drawing Sheets

U.S. PATENT DOCUMENTS 4,197,952 A 4/1980 De Fouw et al.
4,201,139 A 5/1980 Suttles
4,205,815 A 6/1980 Sauer et al.
4,221,443 A 9/1980 Heaney
4,241,669 A * 12/1980 Giambalvo ..... 108/152
4,541,599 A 9/1985 Schoumaker
4,553,725 A 11/1985 Vargo
4,615,448 A * 10/1986 Johnstonbaugh ..... 211/94.01
4,681,233 A 7/1987 Roth
4,681,289 A * 7/1987 Gronlund et al. ..... 248/224.8
4,923,260 A 5/1990 Poulsen
4,996,929 A 3/1991 Saal
5,002,248 A 3/1991 Knape et al.
5,138,803 A * 8/1992 Grossen ..... 52/36.4
5,299,509 A 4/1994 Ballard
5,390,462 A * 2/1995 Kreiter ..... 52/506.05
5,632,389 A 5/1997 Rosenband
5,695,078 A 12/1997 Otema
5,697,589 A * 12/1997 Garfinkle ..... 248/223.41
6,269,906 B1 * 8/2001 Dockter et al. ..... 182/92
6,286,694 B1 9/2001 Battaglia et al.
6,363,645 B1 * 4/2002 Hunter ..... 40/618
7,111,813 B2 9/2006 Lin
7,753,217 B2 * 7/2010 Lawson ..... 211/94.01
7,793,450 B2 * 9/2010 Chasmer et al. ..... 40/657
7,806,279 B2 * 10/2010 Kubota ..... 211/94.01

* cited by examiner

SHELF SUPPORT

FIELD OF THE DISCLOSURE

This disclosure relates generally to supporting devices and, more particularly, to adjustable shelf supports.

BACKGROUND

It is common to support shelves in cabinets or in an open format, such as may be used in book shelves. It also is common to use adjustable shelving in both commercial and residential settings. Shelf supports have been available in various forms, and made of a variety of materials such as metal, plastic, wood or the like. It is desirable to provide shelf supports which do not significantly impair access to the spaces above and below a shelf, which are readily adjustable for use of shelves at a plurality of heights, and which have an improved load capacity.

The present disclosure provides improved shelf supports, each having a stop member that limits deflection within the shelf support, thereby reducing the tendency of the shelf support to bend and become disengaged from an apertured wall member. The improved retention of the shelf supports results in a higher load capacity of the shelf supports and the resulting shelving assemblies.

BRIEF DESCRIPTION OF THE DRAWINGS

In describing the preferred embodiments, reference is made to the accompanying drawings wherein like parts have like reference numerals, and wherein.

It should be understood that the drawings are not to scale and that actual embodiments may differ. It also should be understood that the claims are not limited to the particular embodiments illustrated or combinations thereof.

DETAILED DESCRIPTION

Although the following discloses example improved shelf supports, persons of ordinary skill in the art will appreciate that the teachings of this disclosure are in no way limited to such specific embodiments. On the contrary, it is contemplated that the teachings of this disclosure may be implemented in alternative configurations and environments. In addition, although example shelf supports described herein are shown in conjunction with a particular configuration of an apertured wall member, those having ordinary skill in the art will readily recognize that the example shelf supports may be used to support shelves while engaged in other types of apertured wall members, whether having a channel-shaped portion, being planar or of alternative shapes.

The example shelf supports shown also may provide the optional advantageous feature of providing very minimal obstruction of the space immediately above or below a supported shelf. Depending on the particular configuration and placement of the shelf supports chosen, this may allow items of various sizes to be placed more closely to the ends of the shelves, thereby increasing the usable space.

The disclosed examples may be used in any type of format to support shelves. Thus, the apparatus and/or articles of manufacture and methods disclosed herein may be advantageously adapted to enhance or improve the load capacity of a variety of shelving assemblies. Accordingly, while the following describes example shelf supports and methods of use thereof, persons of ordinary skill in the art will readily appreciate that the disclosed examples are not the only way to implement such shelf supports and/or methods.

Figure 6:
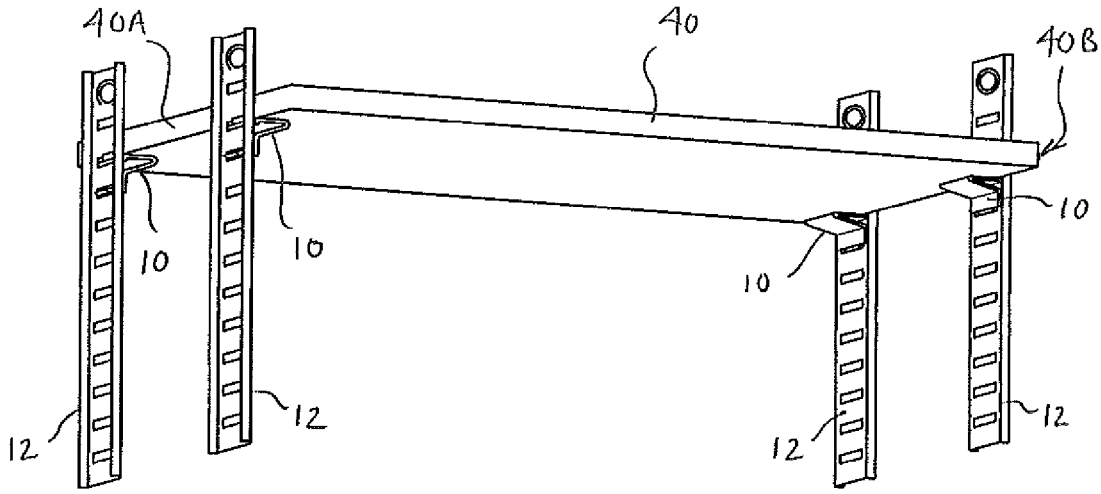
FIG. 6 is a lower perspective view of a plurality of the shelf supports installed in wall members of FIG. 1A and having a shelf supported on the shelf supports.

A first example shelf support 10 is illustrated in FIGS. 1A-1E. The illustrated example shelf support 10 may be formed, for example, of a single piece, and may be constructed from relatively rigid materials, such as metal of plastic. The shelf support 10 is configured to be compatible with a wall member, such as the example wall member 12 shown in FIGS. 1A-1C. The example wall member 12 is of a channel-shape, with a central flat portion 14 and left and right side walls 16 and 18, respectively. The central flat portion 14 has a series of vertically spaced apertures 20 for receipt of the shelf supports 10, and may be connected to a wall, panel or other structure, such as by suitable fasteners, shown for example by way of a screw 21. It will be appreciated that the wall member 12 may be referred to as a standard or pilaster, and other forms of such a wall member may have additional flanges or surfaces. It will be understood that, as shown in FIG. 6, a plurality of wall members 12 will be required to support a shelf 40 and that the wall members will be located along at least two sides 40A, 40B of a shelf 40. Also, it will be appreciated that the wall member 12 may be in the form of a larger panel having apertures therein, as opposed to being in the form of relatively narrow separate vertical components.

The shelf support 10 shown in FIGS. 1A-1E includes a body 22 having at a first end 24 a first lug 26 that is upwardly extending and having at a second end 28 a second lug 30 that is slightly downwardly extending. The body 22 further includes an upper arm 32 that extends relatively horizontally from the first lug 26, and then at bend 34 is bent downward and backward into a lower arm 36 which extends back toward a plane within which the first lug 26 resides and downward, and from which the second lug 30 extends. The second lug 30 extends in a direction substantially perpendicular to the first lug 26. The second lug 30 may include an angled or beveled end to facilitate insertion into an aperture in a wall member 12. The upper arm 32 also includes a stop member 38, illustrated for example in the form of a depression.

The shelf support 10 is configured so as to have a distance D1 between the base of the first lug 26 and the bottom of the second lug 30, when the shelf support 10 is not engaged with a wall member 12. This distance D1 is configured to be slightly greater than a distance D2 between the top of a first aperture 20 and the bottom of a lower positioned second aperture 20 in a wall member 12. While the material of the shelf support 10 is relatively rigid, the body 22 of the shelf support 10 is constructed to have some resilience. Accordingly, the upper arm 32 and lower arm 36 may be forced toward each other, such as by squeezing the body 22, resulting in bending of the upper and lower arms 32, 36 and/or further temporary bending of the shelf support 10 about the bend 34. However, the stop member 38 serves to limit the relative travel of the upper and lower arms 32, 36 toward each other.

Figure 1A:
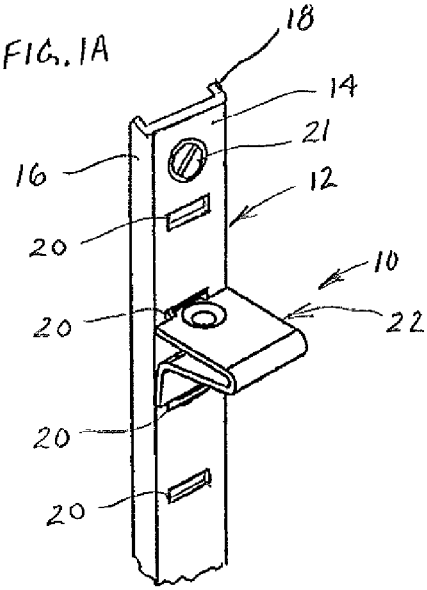
FIG. 1A is a front upper perspective view of a first example shelf support installed in a channel-shaped, apertured wall member.
Figure 1B:
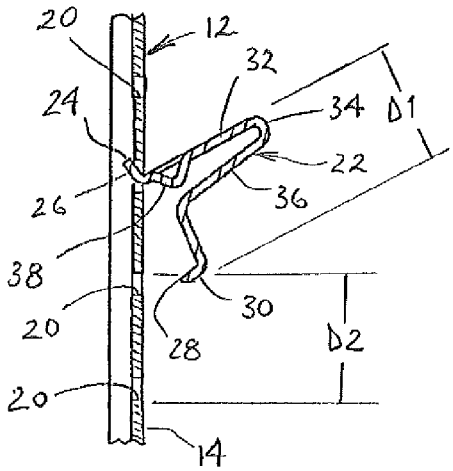
FIG. 1B is a cross-sectional view of the shelf support and a portion of the apertured wall member shown FIG. 1A, with the shelf support in a partially installed position.
Figure 1C:
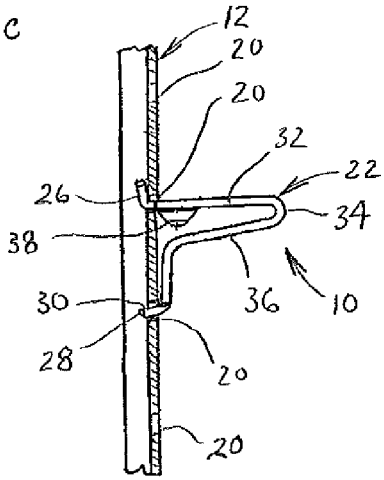
FIG. 1C is a cross-sectional view of the shelf support and a portion of the apertured wall member shown FIG. 1A, with the shelf support in an installed position.
Figure 1D:
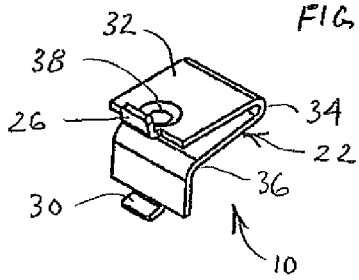
FIG. 1D is a rear upper perspective view of the shelf support shown in FIG. 1A.
Figure 1E:
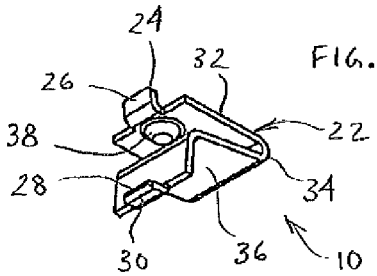
FIG. 1E is a rear lower perspective view of the shelf support shown in FIG. 1A.
Figure 2A:
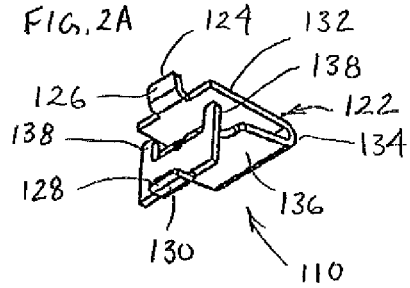
FIG. 2A is a rear lower perspective view of a second example shelf support.
Figure 2B:
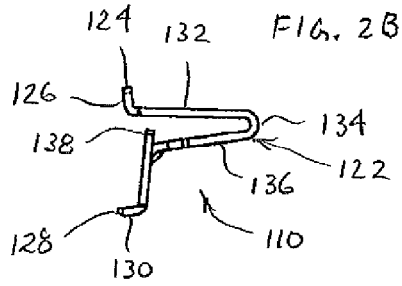
FIG. 2B is a side view of the shelf support shown in FIG. 2A.
Figure 2C:
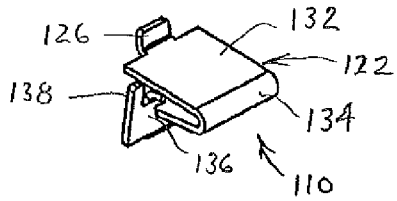
FIG. 2C is a front upper perspective view of the shelf support shown in FIG. 2A.
Figure 2D:
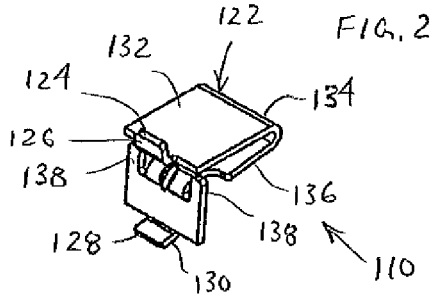
FIG. 2D is a rear upper perspective view of the shelf support shown in FIG. 2A.
Figure 3A:
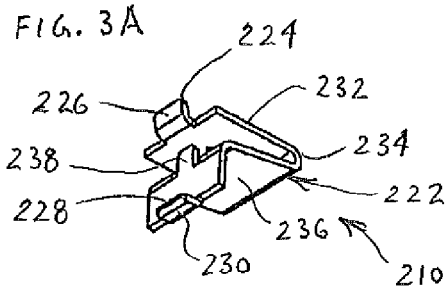
FIG. 3A is a rear lower perspective view of a third example shelf support.
Figure 3B:
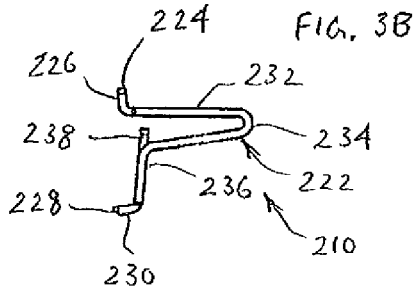
FIG. 3B is a side view of the shelf support shown in FIG. 3A.
Figure 3C:
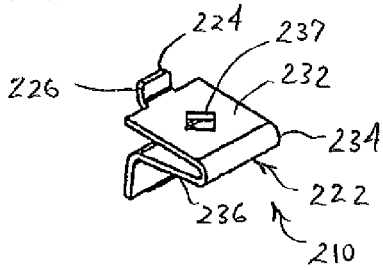
FIG. 3C is a front upper perspective view of the shelf support shown in FIG. 3A.
Figure 3D:
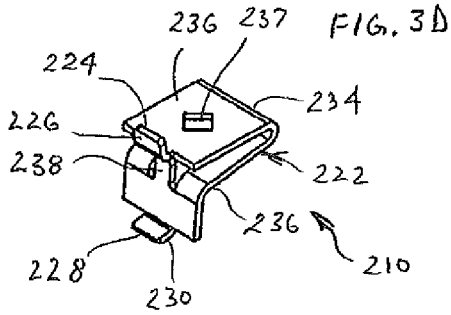
FIG. 3D is a rear upper perspective view of the shelf support shown in FIG. 3A.
Figure 4A:
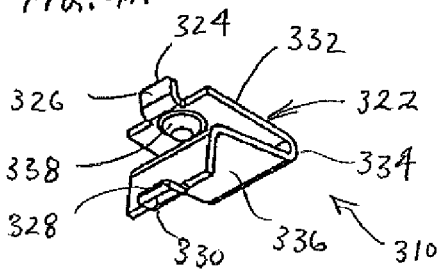
FIG. 4A is a rear lower perspective view of a fourth example shelf support.
Figure 4B:
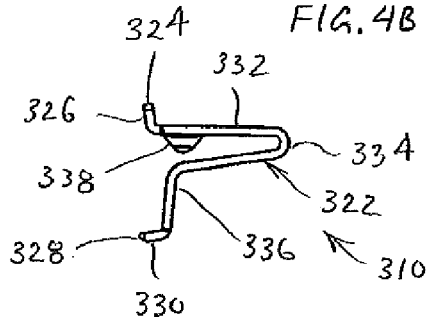
FIG. 4B is a side view of the shelf support shown in FIG. 4A.
Figure 4C:
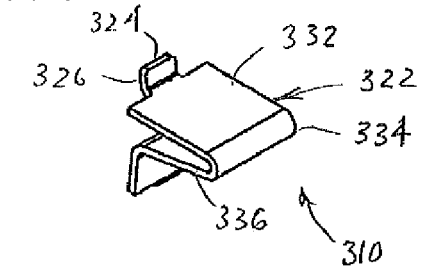
FIG. 4C is a front upper perspective view of the shelf support shown in FIG. 4A.
Figure 4D:
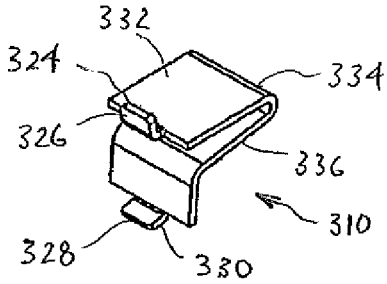
FIG. 4D is a rear upper perspective view of the shelf support shown in FIG. 4A.
Figure 5A:
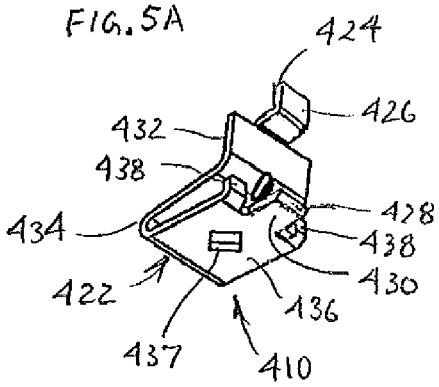
FIG. 5A is a rear lower perspective view of a fifth example shelf support.
Figure 5B:
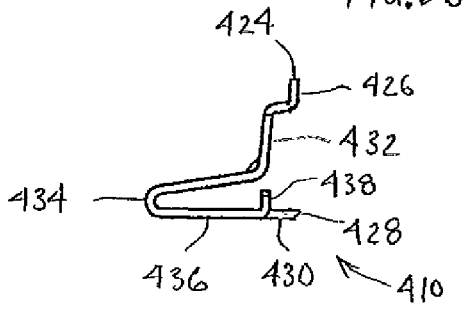
FIG. 5B is a side view of the shelf support shown in FIG. 5A.
Figure 5C:
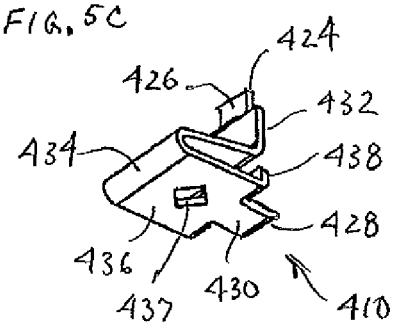
FIG. 5C is a front lower perspective view of the shelf support shown in FIG. 5A.
Figure 5D:
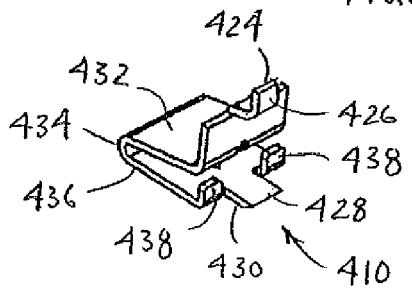
FIG. 5D is a rear upper perspective view of the shelf support shown in FIG. 5A.

To install a shelf support 10 in the wall member 12 having apertures 20, as illustrated in FIG. 1B, a first lug 26 of a shelf support 10 is engaged with, such as by insertion into, aperture 20 in the wall member 12. The shelf support 10 may be squeezed or otherwise deflected to reduce the distance between the first and second lugs 26, 30, and the shelf support 10 is rotated to the position shown in FIG. 1C, to insert the second lug 30 with a lower aperture 20 in the wall member 12. The second end 28 of the second lug 30 may have an angled face for ease of insertion, and may be adapted to permit the second lug 30 to be forced into an aperture 20 of the wall member 12 without advanced squeezing of the shelf support 10.

Once a quantity of shelf supports 10 are installed in an equal quantity of wall members 12 in the manner described immediately above, a shelf 40 may be placed atop the shelf supports 10. Under load, the shelf supports 10 may deflect, causing the first lug 26 to move downward and the upper arm 32 to move toward the lower arm 36. However, the presence of the stop member 38 will serve to transfer load from the upper arm 32 more directly to the lower arm 36 and its respective second lug 30, forestalling a premature release of the first lug 26 from an aperture 20 in the wall member 12, and thereby increasing the relative load capacity of the shelf support 10.

It will be appreciated that other configurations may be made within the spirit of this disclosure, a few of which will be described herein. For instance, a second example shelf support 110 is shown in FIGS. 2A-2D. Shelf support 110 includes a body 122 having at a first end 124 a first lug 126 that is upwardly extending and having at a second end 128 a second lug 130 that is slightly downwardly extending. The body 122 further includes an upper arm 132 that extends relatively horizontally from the first lug 126, and then at bend 134 is bent downward and backward into a lower arm 136 which extends back toward a plane in which the first lug 126 and downward, and from which the second lug 130 extends. In this example, the second lug 130 extends in a direction substantially perpendicular to the first lug 126. As in the earlier example, the second lug 130 may include an angled or beveled end to facilitate insertion into an aperture in a wall member 12. The lower arm 136 also includes a stop member 138, illustrated for example in the form of a pair of upward extensions constructed from portions of the lower arm 136.

It will be understood that the shelf support 110 may be installed in a manner similar to that of the example shelf support 10. It also will be appreciated that the stop member 138, in the form of upward extensions, operates to limit the relative movement of the upper and lower arms 132, 136 toward each other when the shelf support is installed in a wall member 12 and under load.

A third example shelf support 210 is shown in FIGS. 3A-3D. Shelf support 210 has a body 222 having at a first end 224 a first lug 226 that is upwardly extending and having at a second end 228 a second lug 230 that is slightly downwardly extending. The body 222 further includes an upper arm 232 that extends relatively horizontally from the first lug 226, and then at bend 234 is bent downward and backward into a lower arm 236 which extends back toward a plane in which the first lug 226 and downward, and from which the second lug 230 extends. The second lug 230 extends in a direction substantially perpendicular to the first lug 226. The second lug 230 may include an angled or beveled end to facilitate insertion into an aperture in a wall member 12. The upper arm 232 is shown with an optional locating aperture 237, which may be used to engage a complementary locating tab or pin on a shelf (not shown). The lower arm 236 includes a stop member 238, illustrated for example in the form of an upward extension constructed from a portion of the lower arm 236.

The shelf support 210 may be installed in a similar manner to the prior example shelf supports 10 and 110. It will be appreciated that the stop member 238, in the form of a single upward extension, will operate to limit the relative movement of the upper and lower arms 232, 236 toward each other when the shelf support is installed in a wall member 12 and under load.

A fourth example shelf support 310 is shown in FIGS. 4A-4D. Shelf support 310 has a body 322 having at a first end 324 a first lug 326 that is upwardly extending and having at a second end 328 a second lug 330 that is slightly downwardly extending. The body 322 further includes an upper arm 332 that extends relatively horizontally from the first lug 326, and then at bend 334 is bent downward and backward into a lower arm 336 which extends back toward a plane in which the first lug 326 and downward, and from which the second lug 330 extends. The second lug 330 extends in a direction substantially perpendicular to the first lug 326. As in the earlier examples, the second lug 330 may include an angled or beveled end to facilitate insertion into an aperture in a wall member 12. The upper arm 332 is shown with a stop member 338 added to the underside thereof in the form of a protrusion. The stop member 338 may be added such as by placement of a bead of solder or resin, but it will be understood that it may be added in any other suitable form, such as for example in the form of a fastener such as a rivet, a threaded screw or the like.

The shelf support 310 also may be installed in a similar manner to the prior example shelf supports 10, 110, 210. It will be appreciated that the stop member 338, in the form of a single upward protrusion will operate to limit the relative movement of the upper and lower arms 332, 336 toward each other when the shelf support is installed in a wall member 12 and under load.

A fifth example shelf support 410 is shown in FIGS. 5A-5D. Shelf support 410 has a body 422 having at a first end 424 a first lug 426 that extends relatively horizontally and then upwardly and having at a second end 428 a second lug 430 that extends substantially horizontally. The body 422 further includes an upper arm 432 that extends downward from the first lug 426 and then outward relatively horizontally, and then at bend 434 is bent backward into a relatively horizontal lower arm 436 which extends back toward a plane in which the upward extension of first lug 426 resides, and from which the second lug 430 extends in a direction substantially parallel to the lower arm 436. The second lug 430 may include an angled or beveled end to facilitate insertion into an aperture in a wall member 12. In this example, the second lug 430 also extends in a direction substantially perpendicular to the first lug 426. The upper arm 432 is shown with an optional locating aperture 437, which may be used to engage a complementary locating tab or pin on a shelf (not shown). The lower arm 432 is shown with a stop member 438, illustrated for example in the form of a pair of upward extensions constructed from portions of the lower arm 436.

It will be understood that the shelf support 410 may be installed in a manner similar to that of the example shelf supports 10, 110, 210, 310, but will have a greater portion of the shelf support located adjacent a side of a shelf (not shown). It also will be appreciated that the stop member 438, in the form of upward extensions, operates to limit the relative movement of the upper and lower arms 432, 436 toward each other when the shelf support is installed in a wall member 12 and under load.

While the present disclosure shows and demonstrates various example shelf supports that may be adapted for use in shelving assemblies, these examples are merely illustrative and are not to be considered limiting. It will be apparent to those of ordinary skill in the art that various shelf supports may be constructed to be installed in various forms of wall members having spaced apart apertures, so as to be able to support a shelf without departing from the scope or spirit of the present disclosure. Thus, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A shelf support comprising:

a body having a first lug at a first end and a second lug at a second end, the first and second lugs each having a width;

the body having upper and lower arms extending between the first and second lugs and having a bend therebetween, the upper arm having a width that is greater than the width of the first lug and the lower arm having a width that is greater than the width of the second lug;

a stop member extending in a fixed configuration from the body and being disposed between the upper and lower arms; and wherein the stop member permits limited relative movement of the upper arm toward the lower arm and wherein the stop member also prevents disengagement when the shelf support is installed in a wall member and under downward load.

2. The shelf support as defined in claim 1, wherein the first lug extends upward from the upper arm.

3. The shelf support as defined in claim 1, wherein the second lug extends slightly downward from the lower arm.

4. The shelf support as defined in claim 1, wherein the second lug extends in a direction substantially perpendicular to the first lug.

5. The shelf support as defined in claim 1, wherein the second lug extends in a direction substantially parallel to the lower arm.

6. The shelf support as defined in claim 1, wherein the stop member is formed from an impression in the upper or lower arm.

7. The shelf support as defined in claim 1, wherein the stop member is formed as an extension from the upper or lower arm.

8. The shelf support as defined in claim 1, wherein the shelf support is constructed as one integral piece.

9. The shelf support as defined in claim 1, wherein the stop member is added to the body.

10. The shelf support as defined in claim 1, wherein the upper arm further comprises a locating aperture.

11. The shelf support as defined in claim 1, wherein the lower arm further comprises a locating aperture.

12. A method of providing support for a shelf comprising:

providing a plurality of wall members located along at least two sides of a shelf, with each wall member having at least two spaced apart apertures;

providing a plurality of shelf supports in an equal quantity to that of the wall members, with each shelf support further comprising a body having a first lug at a first end wherein the first lug has a width and is adapted to engage a first aperture in a wall member and a second lug at a second end wherein the second lug has a width and is adapted to engage a second aperture in a wall member, and the body of the shelf support having a pair of arms wherein each arm has a width that is greater than the width of each respective lug, and a stop member extending in a fixed configuration from the body and being disposed between the pair of arms and the stop member being configured to permit limited relative movement of the pair of arms toward each other and wherein the stop member also prevents disengagement when the shelf support is installed in a wall member and under downward load; and inserting the first lug of each shelf support into a first aperture in a respective wall member, and inserting the second lug of each shelf support into a second aperture in the same respective wall member.

13. A method as defined in claim 12, wherein after inserting the first lug of each shelf support into a first aperture in a respective wall member, the shelf support is squeezed to move the first arm slightly toward the second arm prior to inserting the second lug into a second aperture in the respective wall member.

14. A method as defined in claim 12, wherein the second lug includes an angled end to facilitate insertion into an aperture of the wall member.

15. A method as defined in claim 12, wherein after inserting the first lug of each shelf support into a first aperture in a respective wall member, the shelf support is rotated downward to insert the second lug into a second aperture in the respective wall member.

* * * * *